US008092259B2

(12) United States Patent
Murata et al.

(10) Patent No.: US 8,092,259 B2
(45) Date of Patent: Jan. 10, 2012

(54) CONNECTOR STRUCTURE, PLUG CONNECTOR, RECEPTACLE CONNECTOR AND ELECTRONIC DEVICE

(75) Inventors: Yoko Murata, Kawasaki (JP); Setsuo Kojima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/503,601

(22) Filed: Jul. 15, 2009

(65) Prior Publication Data

US 2010/0022139 A1 Jan. 28, 2010

(30) Foreign Application Priority Data

Jul. 25, 2008 (JP) ..... 2008-192874

(51) Int. Cl.
*H01R 24/00* (2011.01)

(52) U.S. Cl. ..... 439/660; 439/79

(58) Field of Classification Search ..... 439/608.11, 439/682, 858, 862

See application file for complete search history.

(56) References Cited

U.S. PATENT DOCUMENTS

| | | | | |
|---|---|---|---|---|
| 2,248,082 | A * | 7/1941 | Herman | 439/697 |
| 4,929,193 | A * | 5/1990 | Taylor | 439/567 |
| 5,028,492 | A | 7/1991 | Guenin | |
| 5,213,514 | A * | 5/1993 | Arai | 439/79 |
| 5,230,632 | A | 7/1993 | Baumberger et al. | |
| 5,235,743 | A | 8/1993 | Endo et al. | |
| 5,833,498 | A | 11/1998 | Smyk | |
| 6,537,091 | B2 * | 3/2003 | Hirai et al. | 439/181 |
| 2008/0102710 | A1 | 5/2008 | Sato | |
| 2009/0253284 | A1 * | 10/2009 | Michel et al. | 439/283 |

FOREIGN PATENT DOCUMENTS

| | | | |
|---|---|---|---|
| DE | 102005005127 | A1 | 8/2006 |
| EP | 0782220 | A2 | 7/1997 |
| EP | 1503618 | A2 | 2/2005 |
| JP | 9-283234 | | 10/1997 |
| JP | 2004-288848 | | 10/2004 |

OTHER PUBLICATIONS

Extended European Search Report mailed Jun. 22, 2011 for corresponding European Application No. EP 09165923.

* cited by examiner

*Primary Examiner* — Renee Luebke
*Assistant Examiner* — Larisa Z Tsukerman
(74) *Attorney, Agent, or Firm* — Fujitsu Patent Center

(57) ABSTRACT a connector structure includes: a receptacle connector including (a) a receptacle terminal in which a receptacle contact portion is provided and (b) a housing into which a fiber material is impregnated, and in which a storage space is provided to store the receptacle contact portion; a plug connector engaged into the receptacle connector, the plug connector having a plug terminal in which a plug contact portion is provided, the plug contact portion being inserted between the receptacle contact portion and a partition wall in the storage space; and a contact inhibition member which is provided between the partition wall of the storage space and the receptacle terminal to suppress the plug contact portion from contacting the partition wall of the storage space.

6 Claims, 14 Drawing Sheets

CONNECTOR STRUCTURE, PLUG CONNECTOR, RECEPTACLE CONNECTOR AND ELECTRONIC DEVICE

CROSS-REFERENCE TO RELATED APPLICATION

This application is based upon and claims the benefit of priority of the prior Japanese Patent Application No. 2008-192874, filed on Jul. 25, 2008, the entire contents of which are incorporated herein by reference.

FIELD

Embodiments of the present invention relates to a connector structure, a plug connector, a receptacle connector, and an electronic device.

BACKGROUND

Recent years have seen remarkable progress in miniaturization of the connector structure of an electronic device. This leads to narrowing the pitch between terminals each providing with a contact and increasing the terminal density. With this progress, the connector for electrical connection has been changed to a so-called bellows connector formed by bending a thin plate, from a connector formed by inserting a knife-shaped terminal into a fork-shaped terminal.

For bellows connector, there has been known a connector structure to engage a receptacle connector into a plug connector. The receptacle connector includes a receptacle contact portion which comes in contact with a plug contact portion for electrical connection. The receptacle contact portion is disposed in a housing. The receptacle contact portion has a convex portion formed by bending, and the convex portion is pressed against the plug contact portion. The plug connector includes a plug contact portion which is inserted between the receptacle contact portion and a partition wall in the housing at the time of engaging.

If such a connector structure has a narrowed pitch between terminals, the plug contact portion may be forced to be in contact with the partition wall in the housing. Alternatively, the plug contact portion may be designed to be in contact with the partition wall from the beginning for the compactness and denseness of the connector structure.

Japanese Laid-Open Patent Publication No. 2004-288848 discloses that a fiber material such as glass fiber is impregnated into a resin. Japanese Laid-Open Patent Publication No. 9-283234 discloses that a housing of a connector is formed by impregnating a fiber material such as glass fibers and carbon fibers into a resin. Generally, such the housing of the connector is expected to have has a greater strength and better formability as compared to a housing of resin into which a fiber material is not impregnated.

However, when a resin into which a fiber material such as glass fibers is impregnated is employed in order to increase the strength of the housing, glass fibers may be exposed out of a surface of the housing or the partition wall in the housing.

In case of engaging the connector structures, the plug contact portion may be cut off by the glass fibers exposed out of the partition wall when the plug contact portion is inserted between the receptacle contact portion and the partition wall. Due to the exposed glass fibers, cutting debris may be formed along the longitudinal direction of the plug contact portion to have a string shape.

The cutting debris of the string shape may contact another plug contact portion and another receptacle contact portion to cause a short circuit.

SUMMARY

At least one embodiment of the present invention provides a connector structure that includes: a receptacle connector including a receptacle terminal in which a receptacle contact portion is provided, and a housing into which a fiber material is impregnated, and in which a storage space is provided to store the receptacle contact portion; a plug connector engaged into the receptacle connector, the plug connector having a plug terminal in which a plug contact portion is provided, the plug contact portion being inserted between the receptacle contact portion and a partition wall in the storage space; and a contact inhibition member which is provided between the partition wall of the storage space and the receptacle terminal to suppress the plug contact portion from contacting the partition wall of the storage space.

It is to be understood that both the foregoing general description and the following detailed description are exemplary, and are not restricted to the invention, as claimed.

BRIEF DESCRIPTION OF THE DRAWINGS

Embodiments are illustrated by way of examples and not limited by the following figures.

DETAILED DESCRIPTION OF EXAMPLES OF EMBODIMENTS

Figure 1:
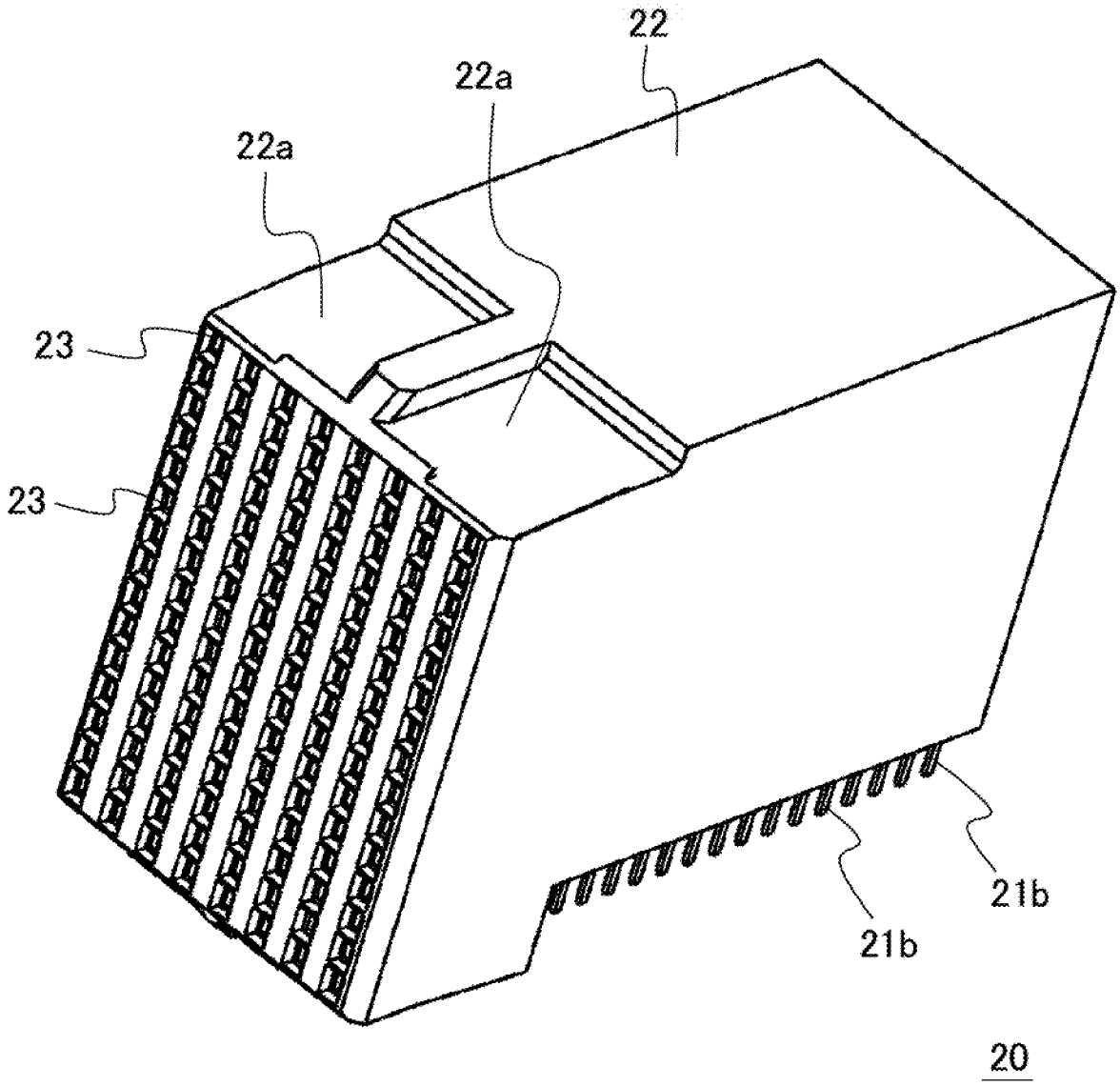
FIG. 1 is a perspective view illustrating a receptacle connector in a connector structure according to an example of an embodiment of the present invention.

In the figures, dimensions and/or proportions may be exaggerated for clarity of illustration. It will also be understood that when an element is referred to as being "connected to" another element, it may be directly connected or indirectly connected, i.e., intervening elements may also be present. Further, it will be understood that when an element is referred to as being "between" two elements, it may be the only element layer between the two elements, or one or more intervening elements may also be present. Like reference numerals refer to like elements throughout.

Figure 2:
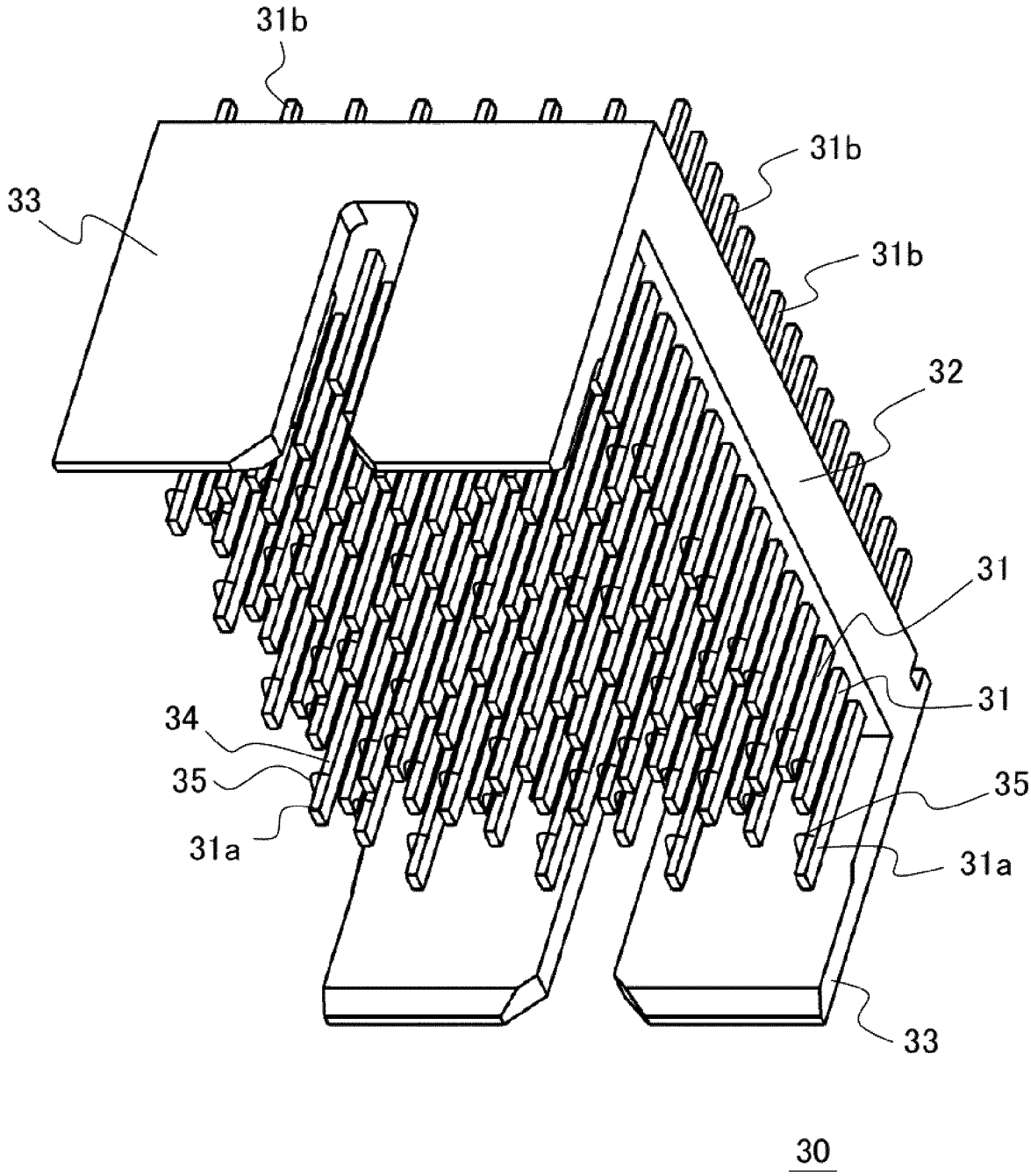
FIG. 2 is a perspective view illustrating a plug connector in the connector structure in accordance with the first example.
Figure 3:
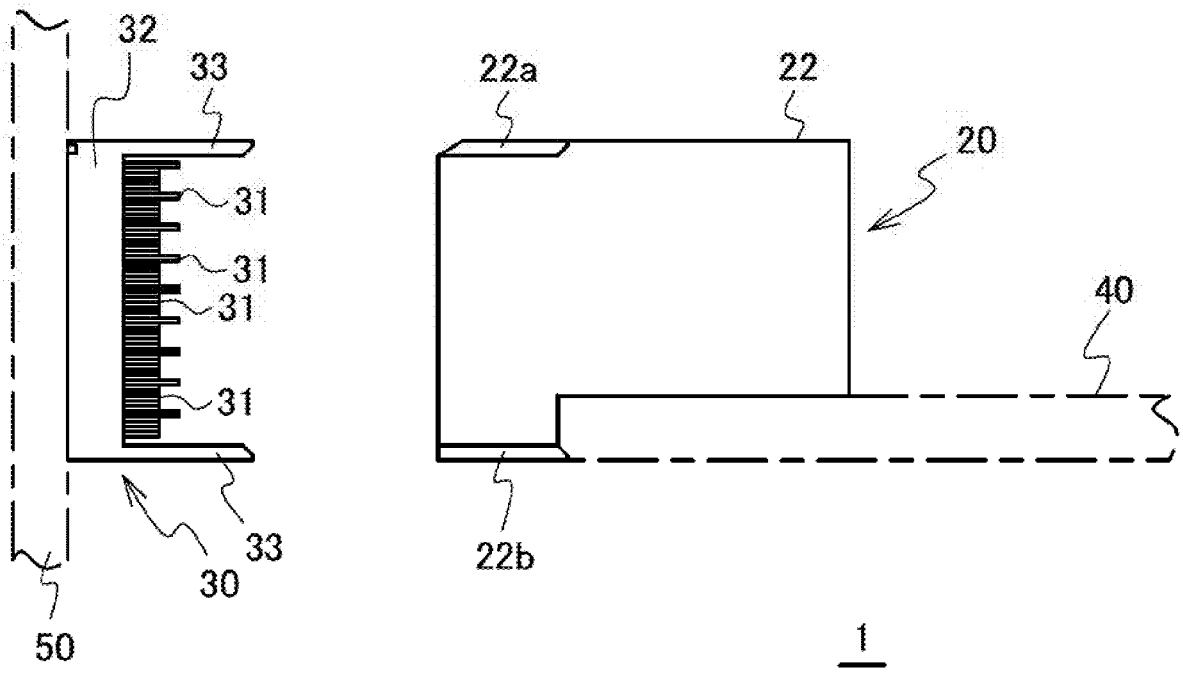
FIG. 3 is a side view illustrating the connector structure of the first example before engaging.
Figure 4:
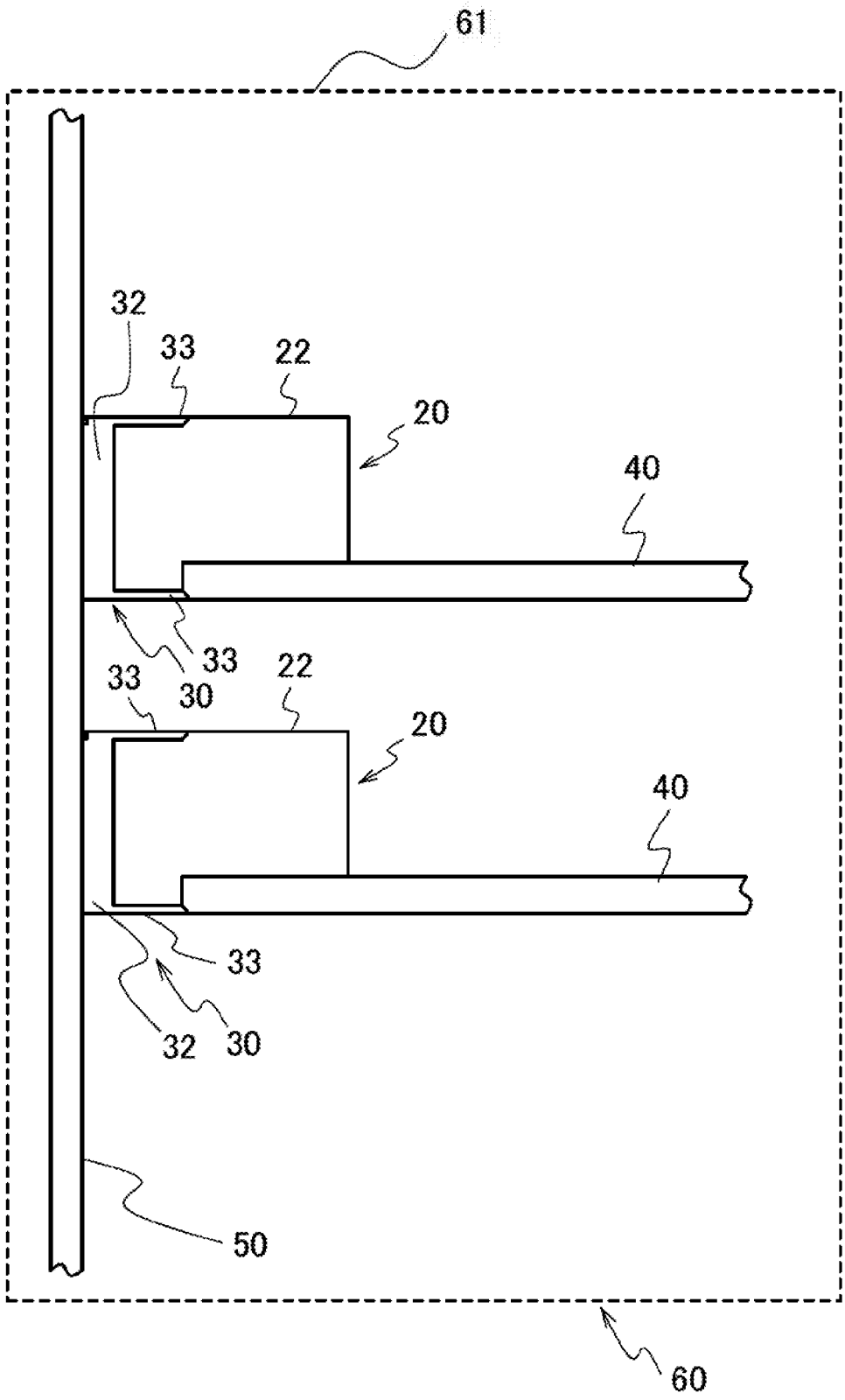
FIG. 4 schematically illustrates an inside of a server using the connector structure in accordance with the first example.
Figure 5:
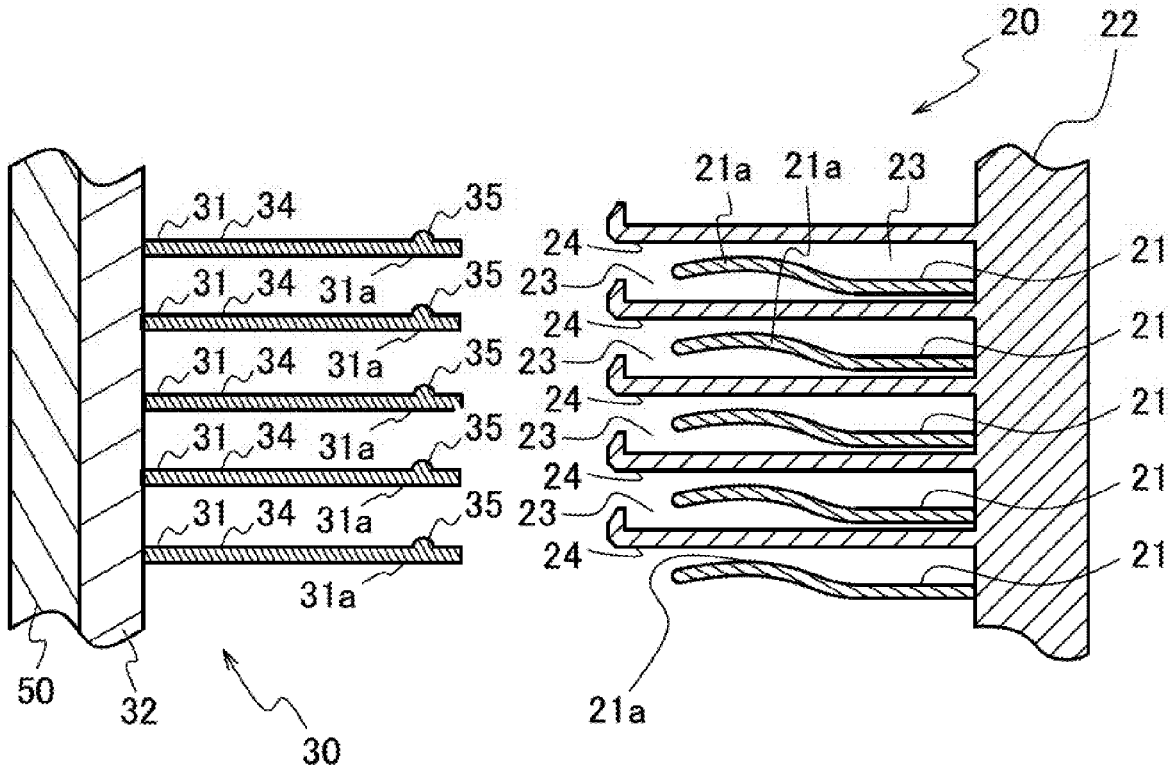
FIG. 5 schematically illustrates the receptacle connector and the plug connector in the connector structure before engaging.
Figure 6:
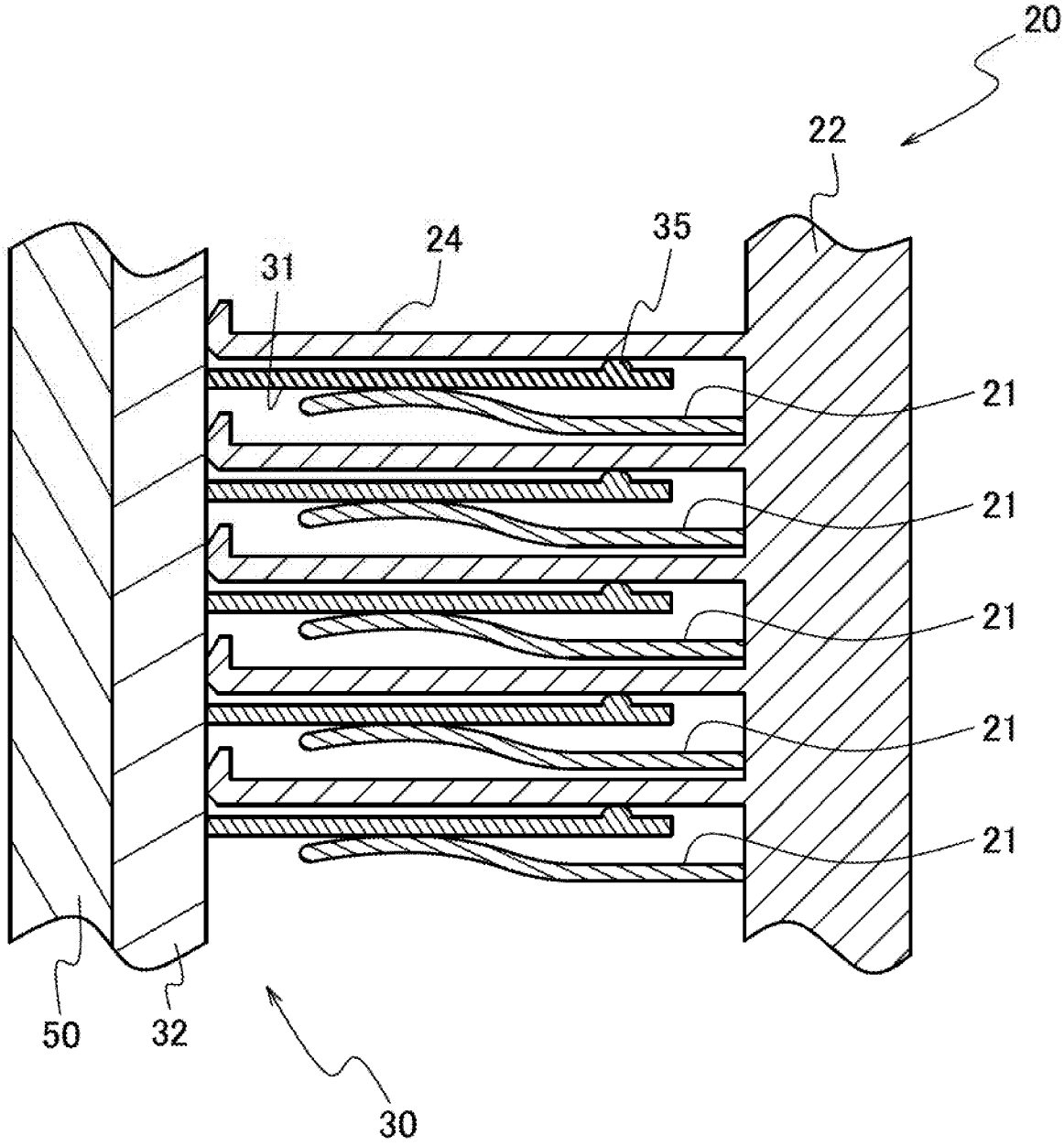
FIG. 6 schematically illustrates the receptacle connector and the plug connector in the connector structure after engaging.

FIG. 1 is a perspective view illustrating a receptacle connector 20 in a connector structure 1. FIG. 2 is a perspective view illustrating a plug connector 30 in the connector structure 1. FIG. 3 is a side view illustrating the connector structure 1 before engaging. FIG. 4 schematically illustrates an inside of a server 60, which is an example of an electronic device using the connector structure. FIG. 5 schematically illustrates the receptacle connector 20 and the plug connector 30 in the connector structure 1 before engaging. FIG. 6 schematically illustrates the receptacle connector 20 and the plug connector 30 in the connector structure 1 after engaging.

The connector structure 1 has the receptacle connector 20 and the plug connector 30 which is engaged into the receptacle connector 20.

As depicted in FIG. 5, the receptacle connector 20 has a terminal 21 on which a receptacle contact portion 21*a* is provided. In addition, the receptacle connector 20 has a housing 22 into which glass fibers, as an example of a fiber material, is impregnated. The housing 22 has a plurality of storage spaces 23 in which each of the receptacle contact portion 21*a* is stored.

The terminal 21 is bent at 90 degrees in the vicinity of the middle, at one end of which there is formed the receptacle contact portion 21*a* and at the other end of which there is provided an insertion end portion 21*b* which is inserted into a pinhole (not shown) which is provided on a board 40. The receptacle contact portion 21*a* is formed into a convex shape. As depicted in FIG. 3, the receptacle connector 20 is mounted on the board 40.

As depicted in FIG. 4, the housing 22 has an engaging portion 22*a* at the upper edge and an engaging portion 22*b* at the lower edge. When the receptacle connector 20 is engaged to the plug connector 30, each of frame plates 33 in the plug connector 30 is engaged to the engaging portions 22*a* and 22*b* of the housing.

As depicted in FIG. 5, the plug connector 30 has terminals 31 which are fixed to a base plate 32. A plug contact portion 31*a* is provided at one end side of the terminal 31, and an insertion end portion 31*b* is provided at the other end side, which is inserted into a pinhole (not shown) provided on a board 50. The base plate 32 has a pair of frame plates 33 which is connected to the upper end and the lower end of the base plate 32. The frame plates 33 extend in a direction perpendicular to the base plate 32. When the receptacle connector 20 is engaged to the plug connector 30, each of the frame plates 33 is engaged to the engaging portions 22*a* and 22*b* of the housing.

As depicted in FIG. 4, the connector structure 1 is used in the server 60, which is an example of an electronic device. The server 60 has a motherboard 50 provided in the enclosure 61. The motherboard 50 is connected to a board 40 such as a daughterboard. The connector structure 1 is used to connect between the motherboard 50 and the board 40.

Figure 7:
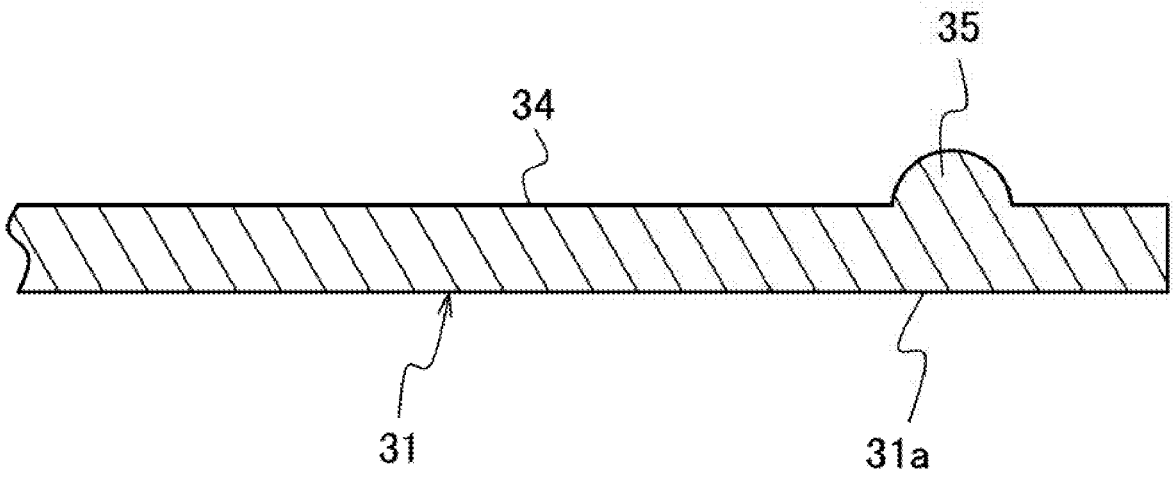
FIG. 7 is an enlarged view illustrating the plug contact portion in accordance with the first example.
Figure 8:
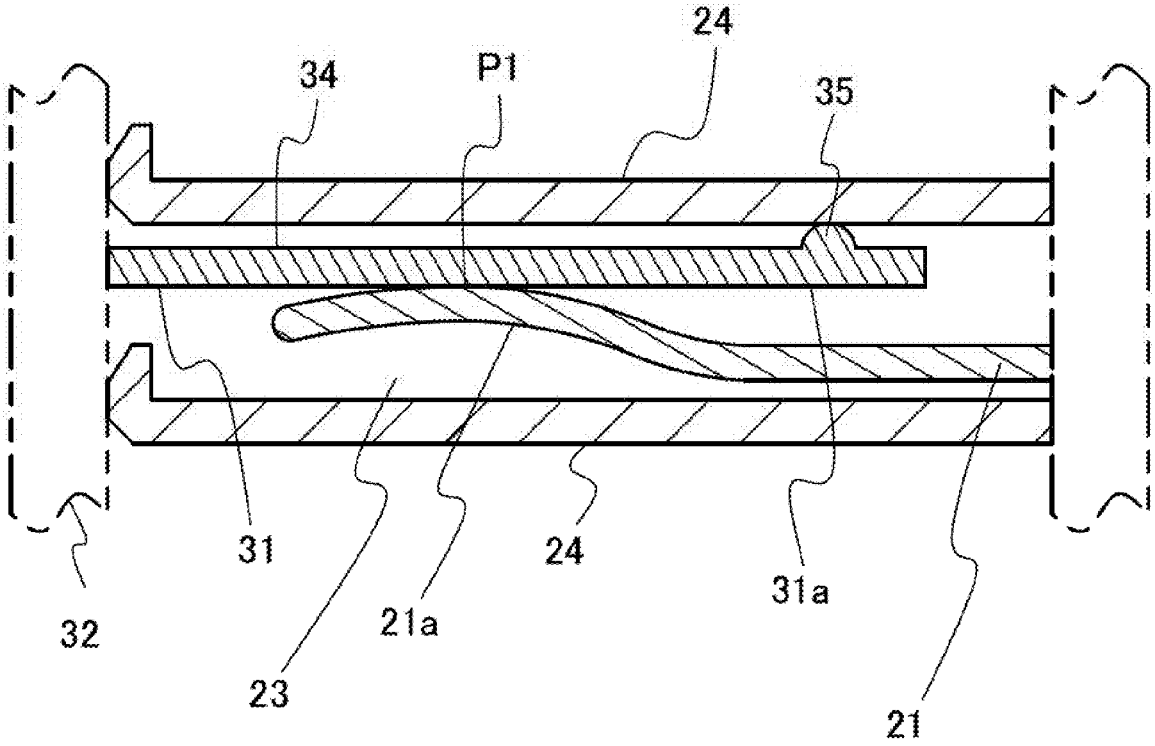
FIG. 8 illustrates a state in which the plug contact portion is engaged to the receptacle contact portion in the connector structure in accordance with the first example.

FIG. 7 is an enlarged view illustrating the plug contact portion 31*a* of the terminal 31. A projection 35 is provided on an upper surface 34 of the plug contact portion 31*a* facing the partition wall 24 in the storage space 23. The projection 35 may be regarded as "contact inhibition member" of the present invention. FIG. 8 illustrates a state in which the plug contact portion 31*a* is engaged to the receptacle contact portion 21*a* in the connector structure 1. The projection 35 is placed in a position closer to the distal side of the terminal 31 away from the contact point P1 with the receptacle contact portion 21*a*. When the plug contact portion 31*a* is inserted into the storage space 23, the projection 35 contacts the partition wall 24 to support the terminal 31 against the partition wall 24. Due to the projection 35, the plug contact portion 31*a* may be suppressed from contacting the partition wall 24.

Figure 9:
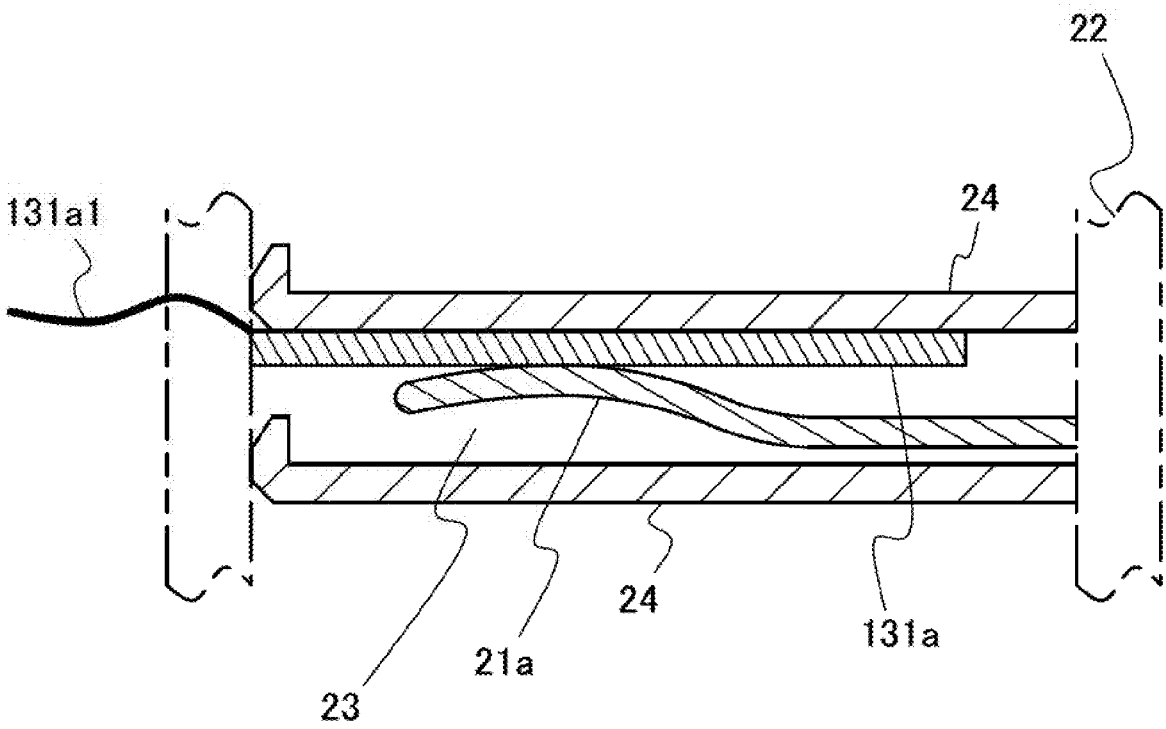
FIG. 9 illustrates a state in which the plug contact portion is engaged to the receptacle contact portion in the connector structure according to a comparative example.

The projection 35 is inserted into the storage space 23 in a state of abutting against the partition wall 24 of the storage space 23. Also, the plug contact portion 31*a* and the receptacle contact portion 21*a* come in contact with each other, and are electrically connected. FIG. 9 illustrates a state in which the plug contact portion 131*a* of a comparative example inserted into the storage space 23. The plug contact portion 131*a* of the comparative example does not have a contact inhibition member such as the projection. The connector structure according to the comparative example is similar to that of the first example illustrated in FIG. 1 except for the plug contact portion 131*a*. Therefore, when the plug contact portion 131*a* contacts the partition wall 24 in the storage space 23, cutting debris 131*a*1 of a string shape is formed due to the glass fiber included in the partition wall 24. This cutting debris 131*a*1 may enter the adjacent storage space 23 to cause a short circuit.

On the other hand, according to the first example in FIG. 1, the plug contact portion 31*a* in the connector structure 1 has a projection 35. Therefore, when the plug contact portion 31*a* is inserted into the storage space 23, the projection 35 instead of the plug contact portion 31*a* contacts the partition wall 24 of the storage space 23. Because the projection 35 is small, with just the top of the small projection 35 contacting the partition wall 24, cutting debris of a string shape is difficult to be formed. Even if some cutting debris is formed, the shape may be powder. The powder shaped cutting debris of a powder shape reduces the possibility of short circuit as compared to the string shaped cutting debris 131*a*1.

The projection 35 which is provided in the connector structure 1 may suppress the occurrence of string shaped cutting debris. This may narrow the pitch between the terminals 21 of the receptacle connector 20. This may also narrow the pitch between the terminals 31 of the plug connector 30. Accordingly, this may allow the connector structure 1 to be more compact and dense.

Figure 10:
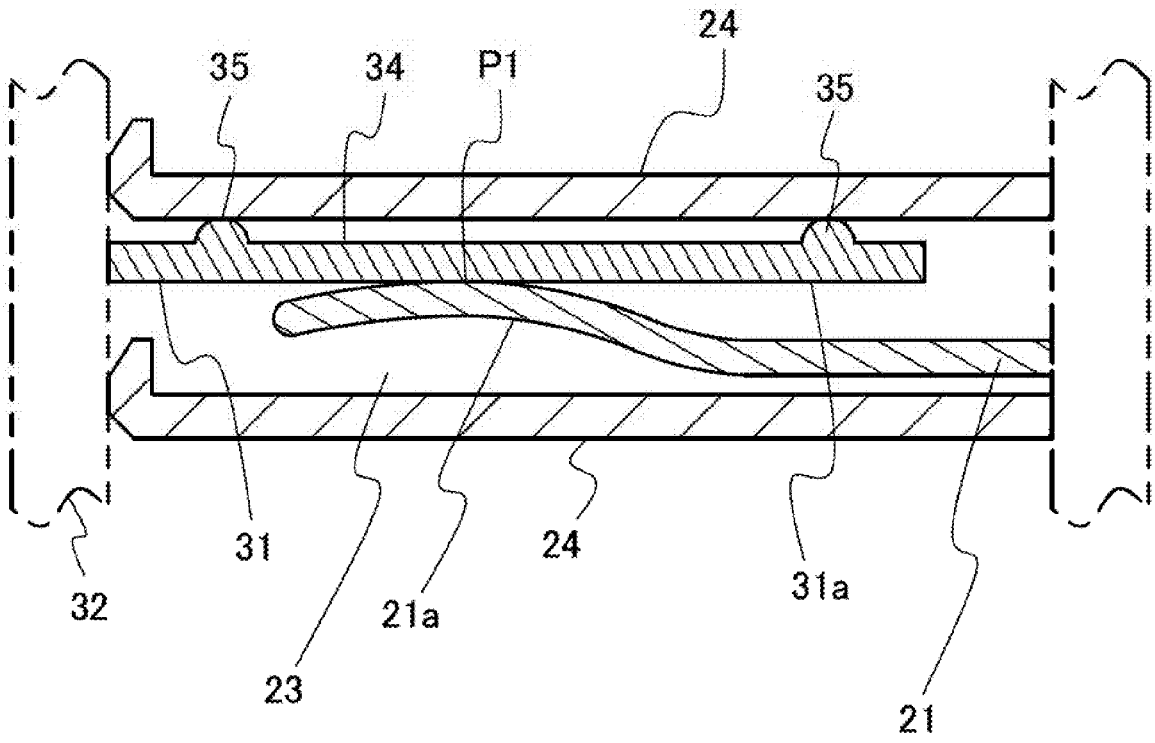
FIG. 10 illustrates a state in which the plug contact portion is engaged to the receptacle contact portion in accordance with a modified example of the first example.

In FIG. 8, a single projection 35 is provided on the plug contact portion 31*a*. However, a plurality of projections 35 may be provided to the plug contact portion 31*a* as depicted in FIG. 10. In this case, one of the two projections 35 may be provided closer to a distal side of the terminal 31 away from the contact point P1 between the plug contact portion 31*a* and the receptacle contact portion 21*a* while the other may be provided closer to a proximal side of the terminal 31. Due to the plurality of the projections 35, the plug contact portion 31*a* may be stably supported. Also, the plug contact portion 31*a* may be suppressed from contacting the partition wall 24. Therefore, this may suppress the occurrence of string shaped cutting debris and short circuit.

Figure 11:
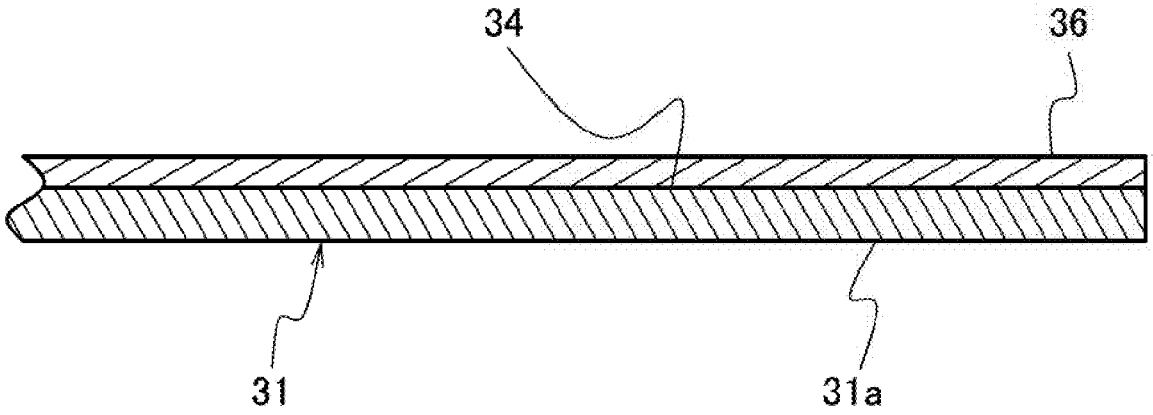
FIG. 11 is an enlarged view illustrating the plug contact portion in accordance with a second example of an embodiment of the present invention.
Figure 12:
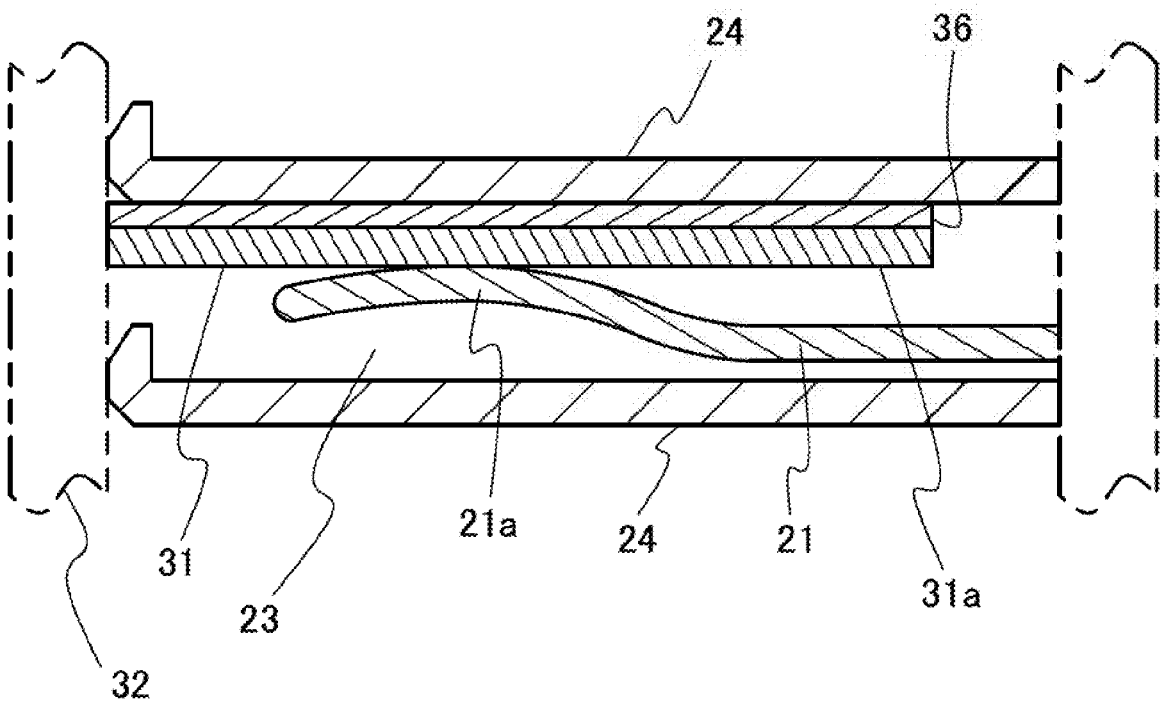
FIG. 12 illustrates a state in which the plug contact portion is engaged to the receptacle contact portion in the connector structure in accordance with the second example.

FIG. 11 is an enlarged view illustrating the plug contact portion 31*a* of the terminal 31 in accordance with a second example of an embodiment. FIG. 12 illustrates a state in which the plug contact portion 31*a* is engaged to the receptacle contact portion 21*a*. The same reference numerals in the drawings are assigned to the same components as in the first example, and some details of substantially the same descriptions may not be repeated below.

Referring to FIGS. 11 and 12, a cover layer 36 is provided as an example of the contact inhibition member instead of the projection 35 of the first example. The cover layer 36 is provided on the upper surface 34 of the plug contact portion 31*a* facing the partition wall 24 in the storage space 23.

The cover layer 36 may suppress contact between the plug contact portion 31*a* and the partition wall 24, and to suppress the plug contact portion 31*a* from being cut off by glass fibers impregnated in the partition wall 24. For example, the cover layer 36 may be formed by metal coating, resin coating, plating, or the like. The cover layer 36 is provided by integrating the terminal 31 of metal with resin through insert molding method.

The cover layer 36 may suppress the plug contact portion 31*a* from directly contacting the partition wall 24. As a result, the plug contact portion 31*a* may be suppressed from being cut off by glass fibers impregnated in the partition wall 24. Therefore, this may suppress the occurrence of string shaped cutting debris and short circuit.

The cover layer 36 may be provided not to disturb an electrical connection between the plug contact portion 31*a* and the receptacle contact portion 21*a*.

Likewise, the cover layer 36 may suppress the occurrence of string shaped cutting debris. This may narrow the pitch between the terminals 21 of the receptacle connector 20. This may also narrow the pitch between the terminals 31 of the plug connector 30. Accordingly, this may allow the connector structure 1 to be more compact and dense.

Figure 13:
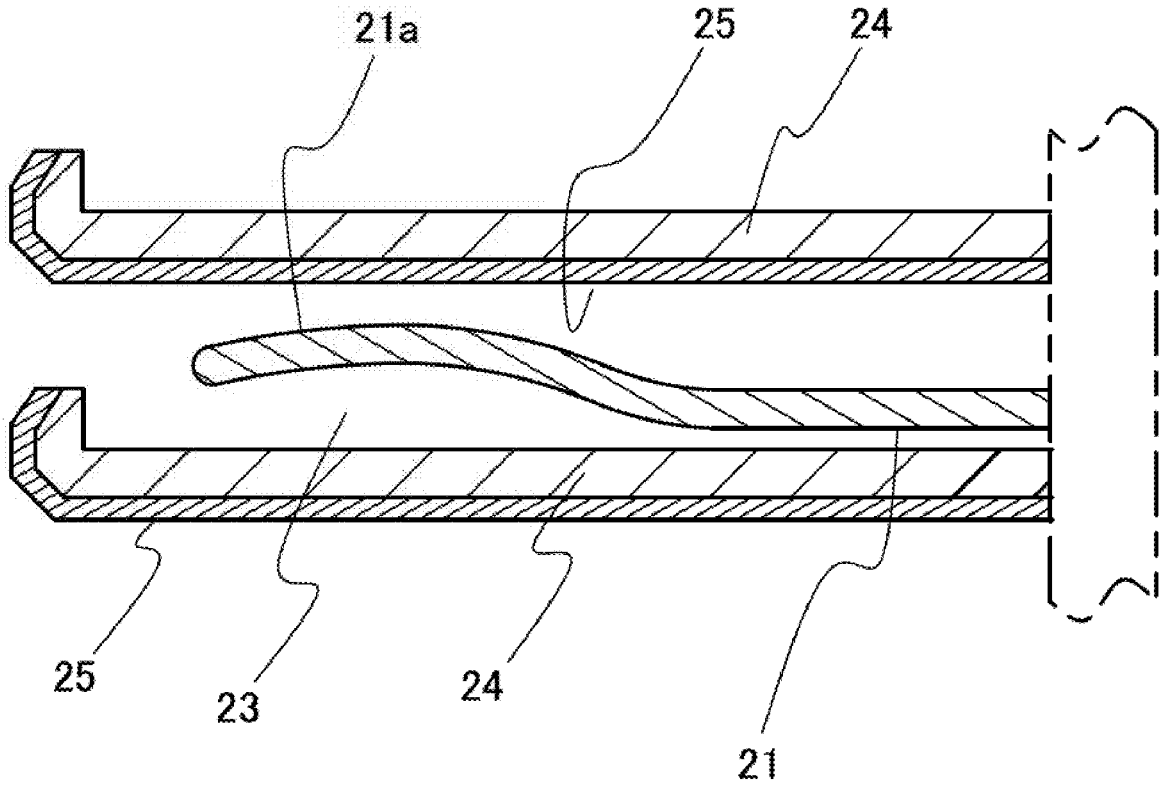
FIG. 13 is an enlarged view illustrating the receptacle contacting portion and a partition wall in the housing in accordance with a third example of an embodiment of the present invention.
Figure 14:
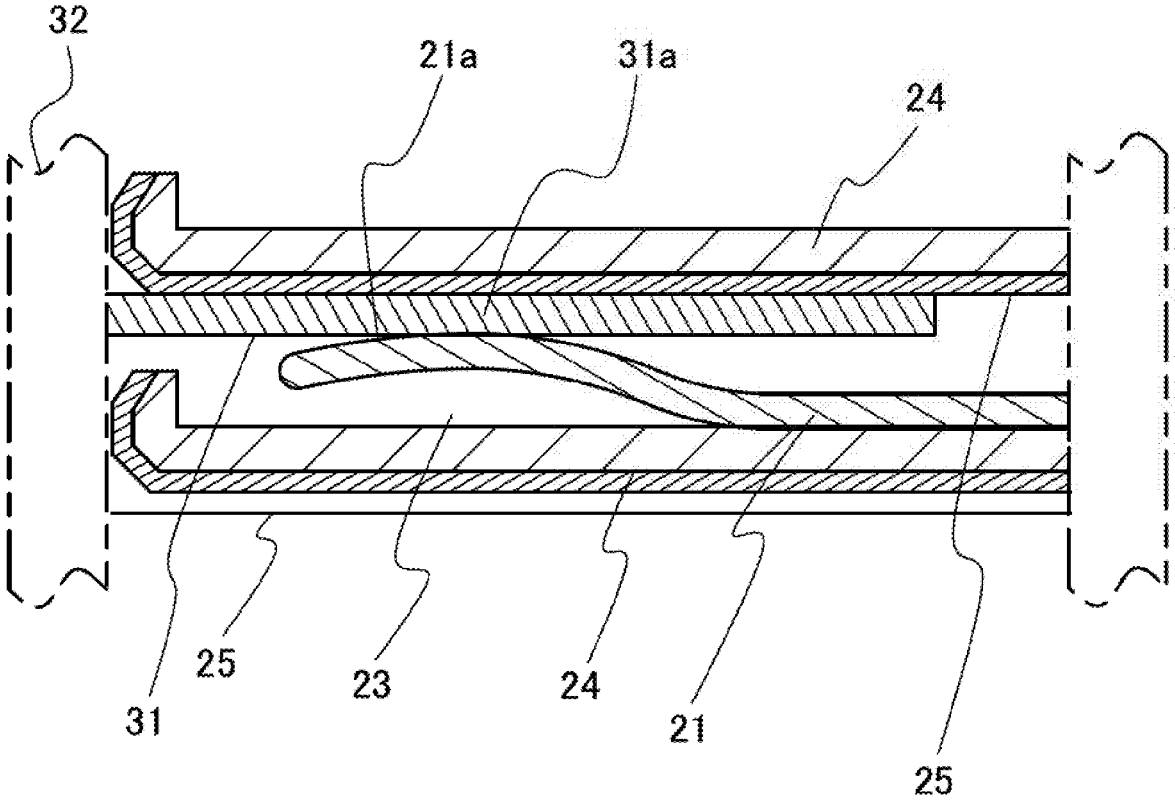
FIG. 14 illustrates a state in which the plug contact portion is engaged to the receptacle contact portion in the connector structure in accordance with the third example.

Next, with reference to FIGS. 13 and 14, a third example of an embodiment of the present invention will be described. FIG. 13 is an enlarged view illustrating the receptacle contacting portion 21*a* and a partition wall 24 in the storage space 23. FIG. 14 illustrates a state in which the plug contact portion 31*a* is engaged to the receptacle contact portion 21*a*. The same reference numerals in the drawings are assigned to the same components as in the first example, and some details of substantially the same descriptions may not be repeated below.

Referring to FIGS. 13 and 14, a cover layer 25 is provided as the contact inhibition member instead of the projection 35 of the first example. Furthermore, the cover layer 25 is provided on the partition wall 24 in the storage space 23 facing the plug contact portion 31*a* unlike the cover layer 36 (FIGS. 11 and 12).

The cover layer 25 may suppress contact between the plug contact portion 31*a* and the partition wall 24, and to suppress the plug contact portion 31*a* from being cut off by glass fibers impregnated in the partition wall 24. For example, the cover layer 25 may be formed by metal coating, resin coating, plating, or the like. Also, the cover layer 25 is provided by integrating the housing 22 of resin with metal through insert molding.

The cover layer 25 may suppress the plug contact portion 31*a* from directly contacting the partition wall 24. As a result, the plug contact portion 31*a* may be suppressed from being cut off by glass fibers impregnated in the partition wall 24. Therefore, this may suppress the occurrence of string shaped cutting debris and short circuit.

The cover layer 25 may be provided not to disturb an electrical connection between the plug contact portion 31*a* and the receptacle contact portion 21*a*.

Likewise, according to the second example, the cover layer 36 may suppress the occurrence of string shaped cutting debris. This may narrow the pitch between the terminals 21 of the receptacle connector 20. This may also narrow the pitch between the terminals 31 of the plug connector 30. Accordingly, this may allow the connector structure 1 to be more compact and dense.

According to the above examples, although the terminal 21 of the receptacle connector 20 is formed bent at 90 degrees, the direction of extending the terminal 21 is not limited. Also, the direction of extending the terminal 31 of the plug connector 30 is not limited. Also, the server 60 has been presented as an example of the electronic device using the connector structure 1, but the connector structure 1 may be adopted for other devices such as a storage device and a communication device.

Examples of embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made therein without departing from the spirit and scope of the present invention as set forth in the claims.

What is claimed is:

1. A connector structure comprising:

a receptacle connector including (a) a receptacle terminal in which a receptacle contact portion is provided and (b) a housing into which a fiber material is impregnated, and in which a storage space is provided to store the receptacle contact portion;

a plug connector to be engaged into the receptacle connector, the plug connector including a plug terminal in which a plug contact portion is provided, the plug contact portion being inserted between the receptacle contact portion and a partition wall in the storage space; and a contact inhibition member provided between the partition wall of the storage space and the receptacle terminal to suppress the plug contact portion from contacting the partition wall of the storage space, wherein the contact inhibition member is a cover layer provided on the partition wall in the storage space facing the plug contact portion.

2. The connector structure according to claim 1, wherein the contact inhibition member is formed with a metal coat layer.

3. The connector structure according to claim 1, wherein the contact inhibition member is formed with a resin coat layer.

4. The connector structure according to claim 1, wherein the contact inhibition member is formed with a plated film.

5. A receptacle connector comprising:

a receptacle terminal in which a receptacle contact portion is provided;

a housing into which a fiber material is impregnated, and in which a storage space is provided to store the receptacle contact portion; and a contact inhibition member which is provided on a partition wall in the storage, wherein the contact inhibition member is a cover layer provided on the partition wall in the storage space facing a plug contact portion to be inserted between the receptacle contact portion and the partition wall.

6. An electronic device comprising an enclosure installing the connector structure therein, the connector structure including:

a receptacle connector including (a) a receptacle terminal in which a receptacle contact portion is provided and (b) a housing into which a fiber material is impregnated, and in which a storage space is provided to store the receptacle contact portion;

a plug connector to be engaged into the receptacle connector, the plug connector including a plug terminal in which a plug contact portion is provided, the plug contact portion being inserted between the receptacle contact portion and a partition wall in the storage space; and a contact inhibition member provided between the partition wall of the storage space and the receptacle terminal to suppress the plug contact portion from contacting the partition wall of the storage space, wherein the contact inhibition member is a cover layer provided on the partition wall in the storage space facing the plug contact portion.

* * * * *